United States Patent [19]

Higgins et al.

[11] Patent Number: 4,570,535

[45] Date of Patent: Feb. 18, 1986

[54] STACKING AND STRAPPING MACHINE

[75] Inventors: George D. Higgins, Orland Park; James Wrona, Burbank, both of Ill.

[73] Assignee: McCain Manufacturing Corporation, Chicago, Ill.

[21] Appl. No.: 662,456

[22] Filed: Oct. 18, 1984

[51] Int. Cl.[4] ..... B65B 13/00

[52] U.S. Cl. ..... 100/7; 100/3

[58] Field of Search ..... 100/3, 7, 26

[56] References Cited

U.S. PATENT DOCUMENTS 3,225,684 12/1965 Smith ..... 100/7 X 4,120,239 10/1978 Pasic ..... 100/26

4,473,005 9/1984 Pasic ..... 100/7

FOREIGN PATENT DOCUMENTS 1030528 5/1966 United Kingdom ..... 100/7

*Primary Examiner*—Billy J. Wilhite

*Attorney, Agent, or Firm*—Kinzer, Plyer, Dorn & McEachran

[57] ABSTRACT

Stacking and strapping machines for magazines in which the turning axes for the conveyors which move a stack to be strapped are positioned to enable the stack to be boxed in while being strapped, the conveyors having pushers which in part enable this to be done in cooperation with fixed stops at the strapping station.

1 Claim, 1 Drawing Figure

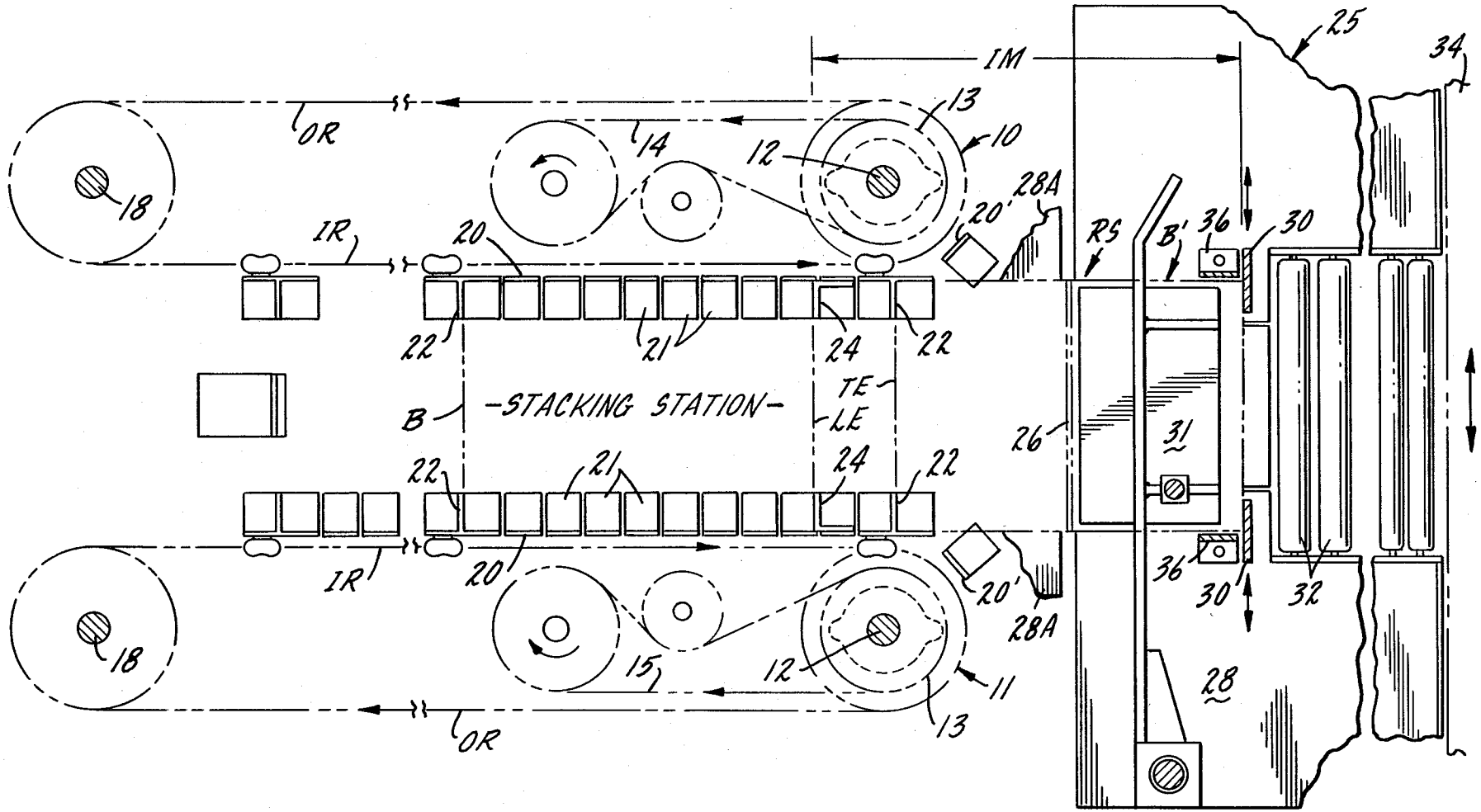
34
25
30
32
36
B'
31
28
RS
26
28A
20'
IM
10
13
22
24
TE
LE
12
STACKING STATION
21
14
20
B
OR
IR
18
11
15

STACKING AND STRAPPING MACHINE

Collating systems for magazines (books) are known in which the books, "gathered" in a signature machine, are arranged for mailing by zip code, saving on mailing costs. As disclosed in application Ser. No. 421,380, filed Sept. 22, 1982, now U.S. Pat. No. 4,483,526 the books may be alternately turned, prior to delivery to a stacking station, so that the backbones (where the signatures are folded) will be alternately stacked to make a neat, even stack.

Advantageously such stacks of magazines should be strapped for easy handling but in those instances when the stacks are small, delivered successively, even some of the better strapping machines cannot keep pace with delivery from the stacking machine. The aim and object of the present invention is to enable a high speed strapper to be combined with the aforesaid magazine stacker, both operating at high speed, and to achieve this object by a certain dimensional relationship which not only allows the two machines to operate at high speed in unison, but also assures an even stack will be maintained during the strapping operation, which is especially important in an instance where a subsequent cross strap is applied.

The drawing is a plan view, partly in section, of a machine constructed in accordance with the present invention.

The combined stacking and strapping machine is shown in the drawing as comprising a pair of opposed endless conveyors 10 and 11, each having an inside run IR and an outside run OR.

Each of the conveyors has a front turning axis or shaft 12 rotated by a sprocket 13. The sprockets in turn are driven by endless chains 14 and 15. This is an indexing drive, that is, chains 14 and 15 are driven in unison so that there is an indexing movement of the conveyors each time a stack of books has been collected as will be explained below.

The shafts 18 which support the opposite end turns of the conveyors are idler shafts.

The conveyors 10 and 11 carry links 20 having support pads 21 in a horizontal plane. When the conveyors have been indexed to a stationary position at the stacking station, the horizontal support pads 21, as can be seen, enable the magazines or books to be stacked one atop another until the stack is completed. This stacking is in accordance with the disclosure in the aforesaid pending application.

At selected positions, the conveyors are provided with longitudinally spaced pushers 22 and 24. The pushers 22 have fixed positions; the pushers 24 are slightly adjustable fore and after relative to the pushers 22 to cooperate therewith to neatly accommodate the stack of books B at the stacking station which takes place, of course, while the conveyor is in a stationary position.

The stack of books B at the stacking station will be in compliance with zip code designations. When the count of books in the stack for the particular zip code is complete, the conveyors are indexed for the next step forward, in the direction of and into the receiving station RS.

The receiving station in this instance includes a strapping machine 25 of the form disclosured in U.S. Pat. No. 4,120,239 capable of encircling the stack of books with a girdling strap 26, encircling the stack of books B′ precisionally at the mid-portion.

This interfacing of the two machines is made possible under and in accordance with the present invention by certain dimensional relationships which will now be explained.

The receiving station RS is defined in part by a support plate 28 in the plane of a like support plate 28A of the stacking machine. Thus when the books are at the receiving station, ready to be strapped, the lower surface of the stack reposes on the support 28–28A. Also, at this time, the leading edge of the stack B′ engages a pair of stops 30. The stops 30 are in a plane normal to the plane of the horizontal support 28–28A and in the drawing are shown in the closed position, stopping the stack of books B′ in position to be strapped. A pad or clamping shoe 31 is then lowered to compact the stack.

The stops 30 are reciprocal so that they may be moved outwardly or away from another to the open position, releasing the strapped stack for advancing movement onto delivery rollers 32, some of which are driven and some of which are idling, so that the strapped stack may be moved from the receiving station RS to a transverse conveyor 34 which will move the strapped stack laterally to a cross strapper (not shown).

A pair of stationary guides 36 at the receiving station prevent lateral shift of the stack to be strapped.

To assure that the stack being strapped is firmly boxed in, so to speak, to assure a neat stack and a tight strap which is especially important in the instance of cross-strapping, the front turning axes 12 of the conveyors 10 and 11 are so positioned with respect to the stops 30 that when the conveyors undergo the indexing movement characterizing advance of the stack out of the stacking station, this indexing step is terminated when the pushers 22 have advanced the stack to be strapped into the plane of an in contact with the back of the stops 30, as shown in the drawing. The timing is, of course, such that the stops 30 are in their closed position at this time while, on the other hand, the pushers 22 have not yet commenced their outward 180° turn along the radius which leads to the outside runs OR. Thus, when the indexing movement IM, advancing the stack of magazines from the stacking station to the receiving station is completed, the stack to be strapped is firmly boxed in between the stops 30 and the leading set of pushers 22.

When the strap 26 is completed, the stops 30 are opened and at the same time the pad 31 is raised so that the strapped stack B′ is ready to be moved out of the receiving station.

Under and in accordance with the present invention, the turning axes 12 are also so located that on the indexing movement which moves stack B to the receiving station, the pushers 22, which help box in the stack to be strapped, push the strapped stack onto the rollers 32 and drop them off there when the pushers 22 have attained the position of the links 20′ in their outward turn. In the meantime, during the same indexing step, the stack of magazines which trails the strapped stack, eventually meets the latter (trailing edge TE met by leading edge LE) and now the strapped stack is pushed by the leading edge LE all the way to cross conveyor 34 which transports the strapped stack laterally to the cross strapper station, not shown.

The invention was necessitated by the fact that some of the stacks of magazines may be as few as six high, one after another. Indexing the conveyor is a matter of tape programming, which is to say there is a considerable time disparity between indexing movements when the stacks are repeatedly twenty-high compared to long stretches of successive stacks only six-high. In the latter case, delivery to the receiving station is very rapid. The strapping machine is also high speed. We solved the interface problem, including the rebounding or bounce-back problem simply by locating the reverse turn axes 12 so that the leading pushers constitute back-up stops in cooperation with the front stops 30 and and guides 36. There can be no bounce; indeed the stack to be strapped is so neatly boxed in that shifting because of the slick covers is quite impossible so there is no crushing or mutilation of the edges of the magazines when the cross strap is applied.

What is claimed is:

1. In a macine for stacking books at a stacking station, and having a pair of laterally spaced endless converyors supported for indexing movement stepwise in unison, said conveyors having inside and outside runs and each being equipped with longitudinally spaced pushers, one opposite another, for successive engagement, at the inside run, with the trailing edges of successive stacks of books to deliver successive stacks of books from the stacking station forwardly in the direction of a receiving station, and wherein the end turns of the endless conveyors between the two stations are each supported on a turning axis for reverse turns 180° outward to their respective outside runs, the pushers diverging from one another and eventually discontinuing contact with the stack during the reverse turn, the improvement comprising:

a support means at the receiving station for receiving successive stacks of books;

stop means positoned for movement in a plane normal to said support means, having a closed position to stop the stack on the support means so the stopped stack may be strapped, and an open position to release the strapped stack;

said turning axes being so spaced rearwardly from the plane of said stop means that when the pushers discontinue movement at the termination of an indexing step they have pushed the stack to be strapped to said plane and back up the trailing edge of that stack; and said pushers being so spaced longitudinally from one another on the related conveyor that when the conveyors are indexed the stack of books advanced by the pushers out of the stacking station push the strapped stack out of the receiving station.

* * * * *